US005288164A

United States Patent [19]

Nasatka

[11] Patent Number: 5,288,164

[45] Date of Patent: Feb. 22, 1994

[54] COMBINED VEHICLE BARRIER

[76] Inventor: Ralph G. Nasatka, 8405 Dangerfield Pl., Clinton, Md. 20735

[21] Appl. No.: 817,641

[22] Filed: Jan. 7, 1992

[51] Int. Cl.[5] ..... E01F 9/00; E01F 13/00

[52] U.S. Cl. ..... 404/10; 404/6

[58] Field of Search ..... 404/6, 9-11; 256/1, 13.1

[56] References Cited

U.S. PATENT DOCUMENTS

| | | | |
|---|---|---|---|
| 3,626,637 | 12/1971 | Rudicel | 49/25 |
| 4,016,679 | 4/1977 | Ellefson | 49/49 |
| 4,090,685 | 5/1978 | Pappas | 246/125 |
| 4,097,170 | 6/1978 | Dickinson | 404/6 |
| 4,101,235 | 7/1978 | Nelson | 404/6 |
| 4,158,514 | 6/1979 | Dickinson | 404/6 |
| 4,318,079 | 3/1982 | Dickinson | 340/127 |
| 4,325,651 | 4/1982 | Szegi | 404/6 |
| 4,367,975 | 1/1983 | Tyers | 404/6 |
| 4,850,737 | 7/1989 | Nasatka et al. | 404/6 |
| 4,974,991 | 12/1990 | Mandavi | 404/6 |
| 4,995,756 | 2/1991 | Kilgrow | 404/6 |
| 5,123,774 | 6/1992 | Dubiel | 404/6 |

FOREIGN PATENT DOCUMENTS

| | | |
|---|---|---|
| 373084 | 6/1990 | European Pat. Off. . |
| 2807118 | of 1979 | Fed. Rep. of Germany . |
| 2398842 | of 0000 | France . |
| 2231844 | 12/1974 | France . |
| 2533250 | 3/1984 | France . |

*Primary Examiner*—James R. Brittain
*Assistant Examiner*—Nancy P. Connolly
*Attorney, Agent, or Firm*—Joseph W. Berenato, III

[57] ABSTRACT

A vehicle barrier for positioning on a roadway or the like includes a support plate adapted for placement across a roadway, a plurality of tread supports formed in series on the support plate with a space between adjacent tread supports, a rod having a row of spikes attached thereto and being rotatably disposed across the support plate so that the spikes are movably received between respective spaced tread supports, a tensioning device for maintaining the row of spikes in a first, upwardly extending position and a device for lowering the row of spikes into a second position between the space tread supports. With this vehicle barrier, a vehicle approaching the barrier from one direction can cause the row of spikes in the first position to rotate downwardly to the second position when its tires impact a spike. But, the row of spikes are maintained in their first upwardly extended position by the tensioning device when impacted by a vehicle approaching from an unauthorized direction thereby puncturing the tires of that vehicle.

20 Claims, 6 Drawing Sheets

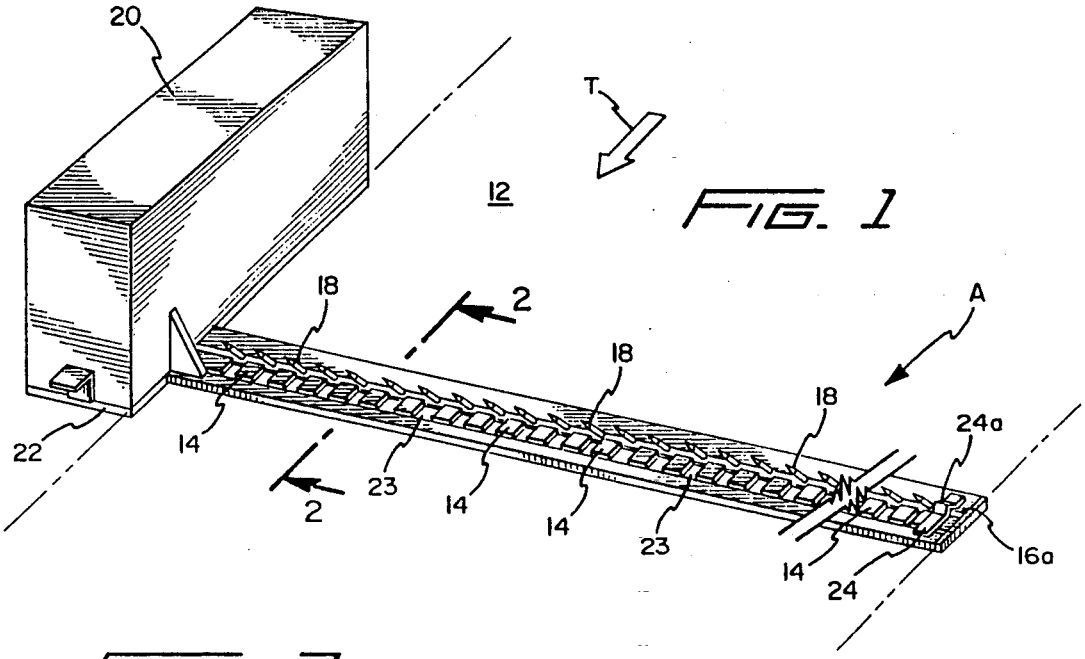
FIG. 1
FIG. 2
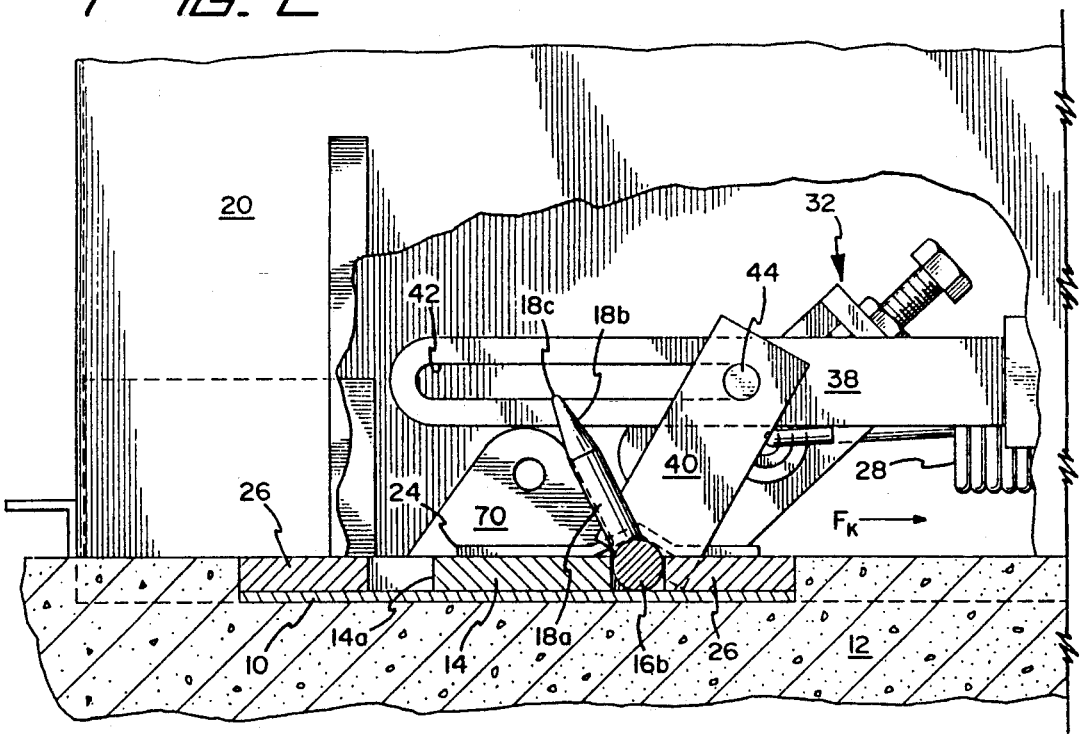

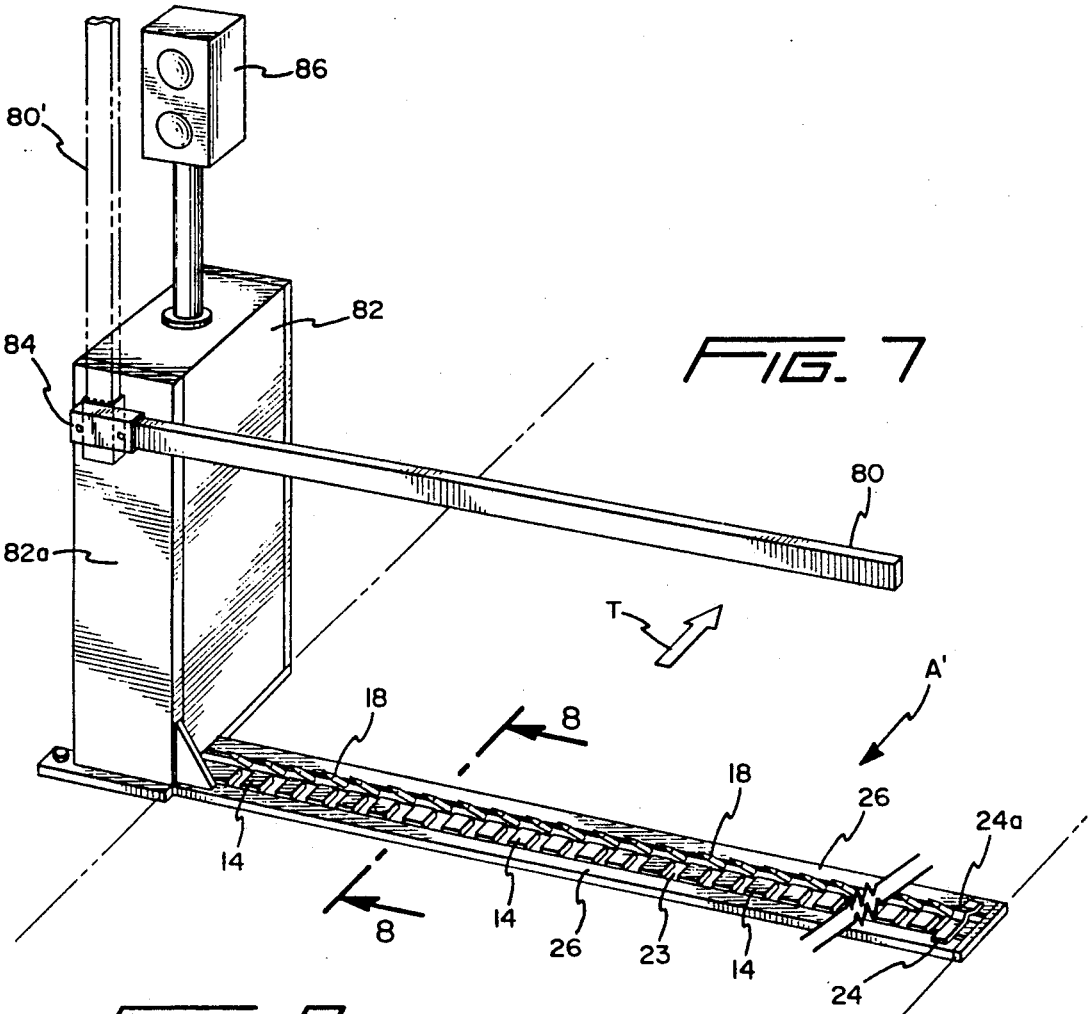
FIG. 7
FIG. 8
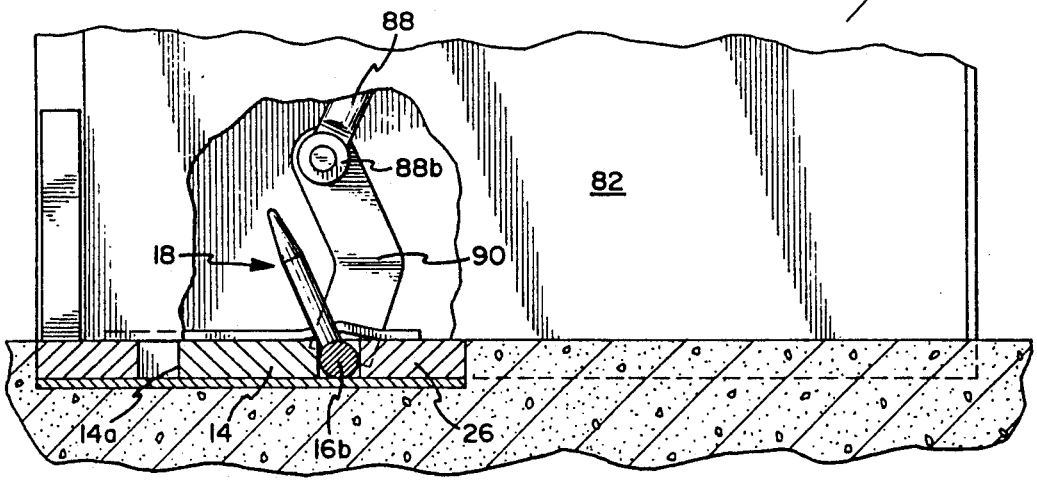

COMBINED VEHICLE BARRIER

FIELD OF THE INVENTION

The present invention relates generally to a barrier for controlling the ingress and egress of vehicular traffic along a roadway and more particularly concerns a barrier which inhibits one direction of traffic flow without stopping a flow of traffic in the other direction.

BACKGROUND OF THE INVENTION

A vehicle barricade is a device disposed across a roadway or the like in order to control passage therethrough. Conventional barricades can be a temporary structure (e.g., a line of orange cones; or a concrete Jersey wall) which serves to prevent any traffic passage, or, a more permanent structure (e.g., retractable gates; pivotable barrier walls) which is selectively operable for vehicle passage. Barricades to be employed at the gate of a secured area or at the entrance and exit points of a vehicle parking area must be movable in order to permit authorized entry or exiting, while preventing unauthorized passage.

Numerous barricades have been proposed for preventing unauthorized access to a facility by transit along a roadway. Generally, such barricades include a barrier which is pivotal between a passage blocking position and a retracted passage position. This barrier is usually pivoted by a mechanical mechanism, such as an hydraulic or pneumatic cylinder and piston, which can be activated by a guard at an observation booth remote from the barricade.

Likewise, an occupant of a vehicle can operate mechanisms of a barrier blocking his entrance into a parking lot, for example, by inserting a magnetic card or obtaining a mechanically dispensed ticket indicating the time of his entrance into the facility. These barrier gates are often placed adjacent a parking attendant's booth to prevent patrons from exiting without paying. However, while these barrier gates deter a significant number of parking lot users from exiting without paying, they cannot withstand the impact force of an onrushing vehicle. Accordingly, an unauthorized exit from such a facility can occur if the vehicle's driver is so inclined.

Known barrier gate arms are usually of a lightweight material (e.g., wooden or hollow) and thus, any damage to a speeding vehicle is minimal. Further, if the entrance of a parking facility is remote from a guarded exit and does not have some sort of barrier, vehicles can slip out the entrance without being detected. This type of unauthorized passage of a vehicle is even more detrimental to the security of a parking facility or an automobile storage area (e.g., a car rental agency or dealership garage or lot).

In an attempt to prevent vehicles from being stolen or from exiting an entrance, barriers with teeth or spikes have been installed which can be retracted enabling cars to cross safely in one direction but display a plurality of spiked ends projecting menacingly toward vehicles travelling in the wrong direction. If a driver ignores this visible warning and attempts to leave through such a barricaded exit, the tires of his vehicle are severely punctured immediately resulting in flat tires and thus, preventing the vehicle from leaving the facility. U.S. Pat. Nos. 4,101,235; 4,318,079 and 4,367,975 illustrate and describe conventional traffic controller barriers of this type. However, these barriers employ complicated mechanical and electronic control equipment for actuating and/or retracting spike like obstructions. Further, it is known to couple ground level barriers with gate barriers which are more visible to drivers; however, larger motors and more complicated circuitry is required to operate the two barriers in unison.

Other known spiked barriers have individually mounted teeth which can flatten out under the weight of a vehicle moving in the authorized direction. While expensive and complicated electrically operated motors are not required to retract individually pivotable teeth, either an excavated recess or above grade bump is required to house the individual springs and other mechanisms necessary to manually activate the teeth individually. U.S. Pat. Nos. 4,016,379; 4,158,514; and 4,325,651 are representative of these one-way manually actuated devices.

Unfortunately, these spike barricades occasionally puncture the tires of an entering vehicle after they have cleared the barricade. Moreover, they require excavation of a roadway or the presence of a bump. A further disadvantage to these unattended spike barricades is that the damaging spikes could be rendered ineffective by the weight of an adult person or by an object such as a pillow. Thus, the problem of unauthorized entry and exiting of a facility is not overcome by known barricades with spiked ends, especially those installed at locations remote from an attendant.

Therefore, it can be seen that there is a need for an inexpensive pivotal barricade for use in areas remote from an attendant's booth which inhibits unauthorized entry or exiting in one direction, but permits safe passage of a vehicle traveling in the opposite direction, as well as a simple motorized barrier system for controlling vehicle traffic.

OBJECTIONS AND SUMMARY OF THE INVENTION

A principal object of the present invention is to provide a vehicle barrier for controlling traffic flow which is simple and inexpensive to manufacture and install.

More particularly stated, it is an object to provide a simple vehicle barrier which a vehicle moving in one direction can deactivate for a length of time sufficient for safe passage, but is immediately reactivated for blocking or inhibiting vehicles traveling in the opposite direction for passage.

Similarly, it is an object of the invention to provide a vehicle barrier with a retractable teeth which can be deactivated by the vehicle itself and improved tensioning means for preventing unauthorized interference with the lowering of the gate.

Yet another object is to provide a slim traffic controlling vehicle barrier which can be installed on top of a roadway without excavation and does not present a bump or other domed obstacle which authorized traffic must cross.

It is an associated object to provide traffic controlling barrier with a retractable gate which is held in its blocking position by a tensile force creating a torque force so great that a single force applied to the teeth cannot cause the teeth to retract. Thus, the vehicle barrier according to the invention requires at least three (3) persons to steal a car.

Another object of the present invention is to provide a vehicle traffic controlling system including a grade-level barrier with retractable teeth positioned in a roadway for blocking traffic and a swinging gate member movably mounted above said barrier which extends across the entire roadway and indicates whether the road is open or closed to a vehicle driver.

It is a further object of the present invention to provide a vehicle traffic controlling system which includes means for interconnecting the movement of the swinging gate with that of the retractable teeth so that the two barriers can move simultaneously between open and closed positions.

A related object of the invention is to provide such a combined barrier with electrically actuated controls for remotely opening and closing the swinging gate and retractable teeth simultaneously.

Still another object is to provide an electronically controlled vehicle traffic controlling barrier system which can be manually overridden so that the retractable teeth of a grade level barrier and an optional swinging gate arm can be simultaneously moved into a continuous open or closed position.

Yet another object of the invention is to provide a counterspring mechanism with adjustment means for permitting a low horsepower motor or the like to be used thus reducing space and costs.

The above objects are achieved by the vehicle barrier according to the present invention which includes a support plate adapted for placement across a roadway, a plurality of tread support means formed in series on the support plate with a space between adjacent tread support means, a rod having a row of spikes attached thereto and being rotatably exposed across the support plates so that the spikes are movably received between respective space tread support means, tensioning means for maintaining the row of spikes in a first position above the tread support means, and means for lowering said row of spikes from said first position into a second position within respective spaces formed by adjacent tread support means.

Other aspects of the invention are achieved by a combined barrier for controlling vehicle traffic which has a grade-level vehicle barrier and further includes a housing disposed adjacent an end of the support plate of the vehicle barrier, swinging gate means mounted to the housing above the retractable row of spikes of the vehicle barrier for movement between open and closed positions, means for interconnecting the movement of the swinging gate means with the movement of the row of spikes and operating means for moving the swinging gate means and row of spikes between open and closed positions.

A feature of a vehicle barrier according to the invention is that there are only three moving parts: the rod of spikes; the spring of the tensioning means; and a screw-threaded rod of the adjustment means. As a result, the vehicle barrier is simple in construction as well as rugged and durable therefore being easy to maintain and service.

Another feature of the invention is that the tensioning means is such that a single adult person cannot cause the spikes to be lowered into an ineffective position.

It is yet another feature that the tensioning means includes stop means which prevent the angular position of the plurality of spikes to increase. Thus, an advantage is achieved in that the tension setting (and force required to overcome the same) remains in the predetermined settings, as does the row of spikes.

A further feature of the invention is that the level-grade barrier sets low to the ground due to its slim construction, approximately 1½ inches in height. As a result, a smoother authorized passage is provided than associated with conventional ramped and domed barriers.

A feature of the combined barrier is that a small, inexpensive to run, motor or drive means such as an electric solenoid air hydraulic or other means can be employed to drive a cylinder and piston arrangement which causes the swinging gate arm and row of spikes to move between open and closed positions.

BRIEF DESCRIPTION OF THE DRAWINGS

Other objects, features and advantages of the invention and a better understanding of its construction and operation will become apparent from the following description, taken in conjunction w accompanying drawings in which:

FIG. 1 is a perspective view of a grade-level vehicle barrier in accordance with the invention;

FIG. 2 is a partial sectional view taken along the line 2—2 of FIG. 1 with a portion of the housing removed showing the mechanically operative structure of the barrier;

FIG. 7 is a perspective view of a combined barrier for controlling vehicle traffic flow according to the invention;

FIG. 8 is an enlarged, fragmentary, sectional view taken along line 8—8 of FIG. 7 with a portion of the housing removed showing a portion of the mechanically operative structure of the barrier;

DESCRIPTION OF THE PREFERRED EMBODIMENT

Figure 3:
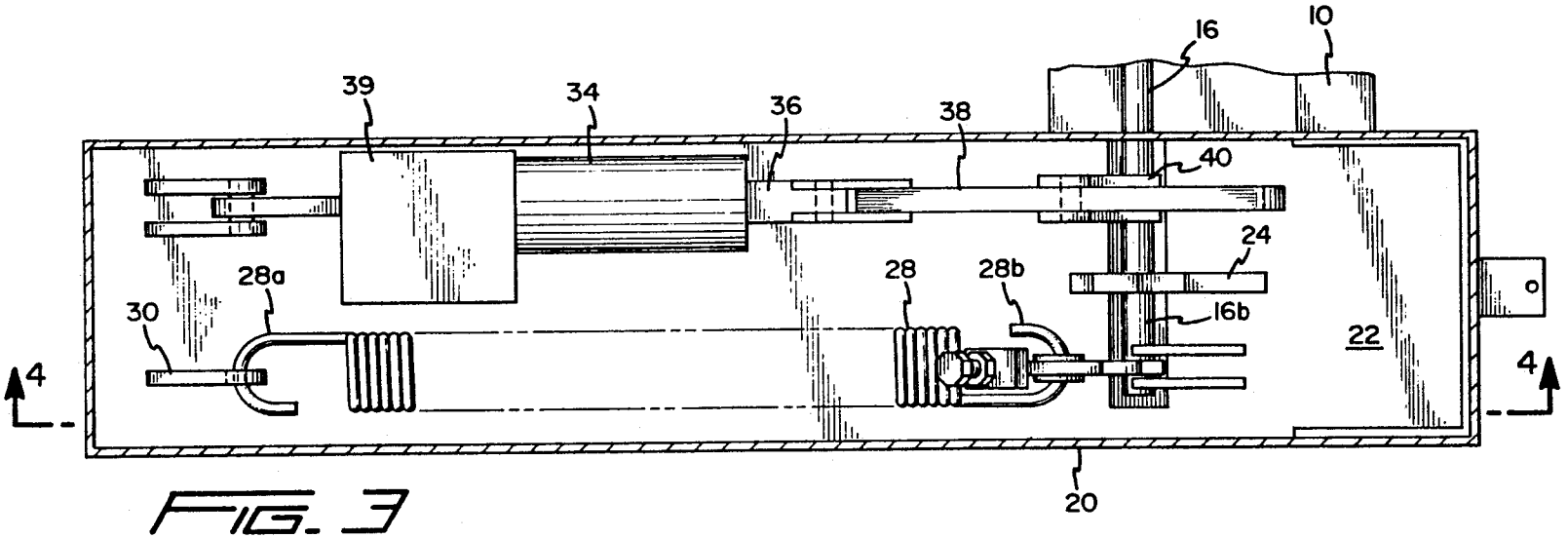
FIG. 3 is a fragmentary top view of the vehicle barrier with the housing shown in cross-section revealing mechanisms for operating the vehicle barrier according to the invention.
Figure 4:
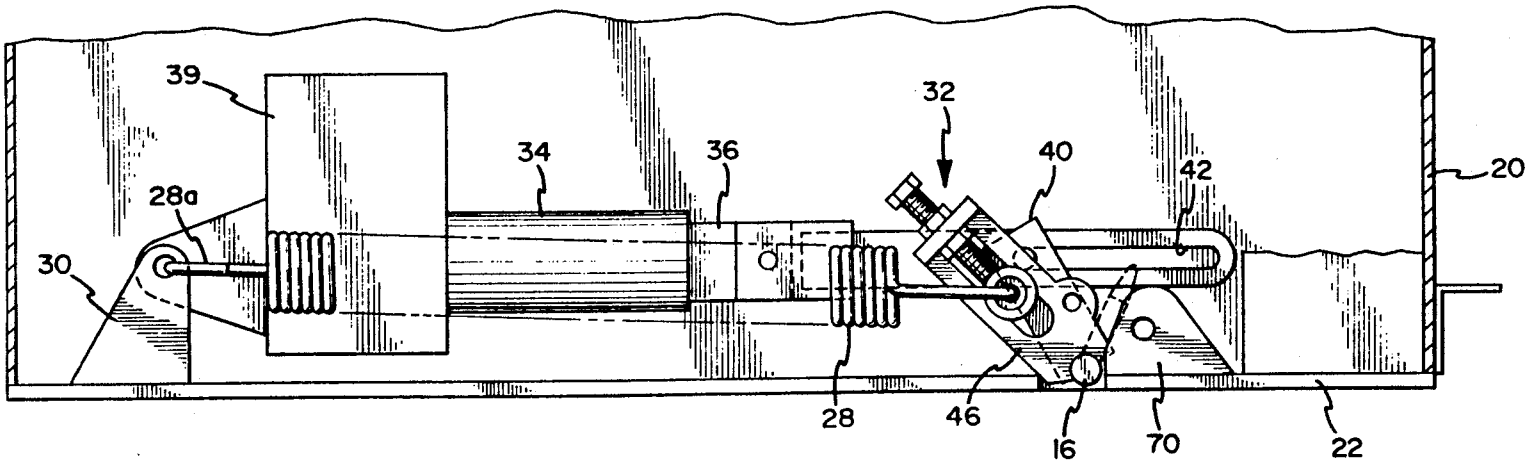
FIG. 4 is a fragmentary, side elevational view of the operating mechanisms of FIG. 3 illustrating their operative position for holding the row of spikes in the raised position.

Referring to FIG. 1, a vehicle barrier A in accordance with the invention has a support plate 10 for placement across a roadway 12, a plurality of tread support blocks 14 formed in series on support plate 10 with a space between adjacent tread support blocks, a rod 16 having a row of spikes 18 extending therefrom, and a housing 20 disposed adjacent one end of support plate 10 which encloses a plurality of operating mechanisms (see FIGS. 3-4). Support plate 10 and a floor plate 22 of housing 20 are provided with any suitable fastening means (not shown) for keeping the same anchored firmly in place beside and across roadway 12.

In accordance with one embodiment of the invention, grade level vehicle barrier A is adapted for installation across a vehicle driveway or the like and is designed so that vehicle traffic moving in an authorized direction (indicated by arrow T) of travel can safely cross while traffic moving in the wrong-way is blocked or inhibited by the raised row of spikes 18. The length of support plate 10 and rod 16, as well as the number of tread support blocks 14 and spikes 18 may vary depending upon the width of the roadway 12 on which traffic control is desired. Tread support blocks 14 can be welded to support plate 10 or support plate 10 can be formed with the support blocks.

Spikes 18 are appropriately shaped with sharp points and normally project from roadway 12 at an angle to puncture tires of a vehicle attempting to cross vehicle barrier A in the wrong direction, but are movable as a unit when depressed by vehicle tires which engage individual spikes and which move in the direction in which the teeth are angled. Preferably, the row of spikes 18 form an angle of 65° with support plate 10 for puncturing tires of vehicles moving in the unauthorized direction T.

The spacing between adjacent tread blocks 14 should be wider than the spike 18 to receive a spike 18, and the row of spikes 18 extending from rod 16 are in spaced alignment so that each tire of a vehicle impacts at least one of the spikes 18 when crossing or attempting to cross the vehicle barrier A. Preferably, the maximum space between adjacent spikes 18 in a vehicle barrier A designed for standard passenger vehicles would be approximately 4 inches. The tread blocks 14 are spaced and form openings for ease in cleaning out gravel and debris which may collect in the spaces 23 and cause problems with the spikes 18 when lowered in the spaces 23.

A bracket 24 with a recess portion **24*a* can be mounted via conventional means on one end of support plate 10 to hold down an end 16*a* of rod 16 remote from housing 20. The other end 16*b* of rod 16 extends through housing 20 and is in communication with the operating mechanisms enclosed in housing 20 which maintain the row of spikes 18 in a first position (see FIG. 1) extending above spaced tread support blocks 14 and forming an acute angle with support plate 10. But, the operating mechanisms permit rod 16 to rotate causing the row of spikes 18 which may be welded to rod 16 to be lowered between spaced tread support blocks 14** when impacted by a vehicle approaching barrier A from the authorized direction T.

As shown in FIG. 2, in addition to tread support blocks 14, a tread support plate 26 can be disposed across and on support plate 10 behind disposed rod 16 so that the rod of spikes 18 is rotatably mounted between tread support plates 26 and the row of spaced tread blocks 14. Tread support plate 26 has a length substantially equal to support plate 10 and a height substantially equal to the height of each tread block 14 to provide a smooth surface for vehicle tires to travel across when moving in the authorized direction T. Preferably, the height of the resultant barrier is approximately 1½ inches and is of relatively slim construction. However, if smoother passage is desired, the top of tread support blocks 14 and tread support plate 26 can be mounted flush with the surface of a roadway 12. For this embodiment, support plate 10 is embedded in roadway 12 after its surface is prepared via conventional means. Relatively minor roadwork is required to prepare an existing road for such a flush mount.

Housing 20 is removable from floor plate 22 to access the operating mechanisms or can be locked shut enclosing the mechanisms within housing 20. The simple operating mechanisms may include a spring 28 which is fixed at one end **28*a* to an immovable member 30 which is mounted on floor plate 22 of housing 20. The other end 26*b* of spring 28 engages an adjustment device 32 for adjusting and setting the angular position of the row of spikes 18** when in the first position.

The normal positioning of the row of spikes 18 is established by an extended position of spring 28 which creates a tensile force which can be modified by an adjustment device 32. The row of spikes 18 are maintained in the first position projecting above tread support blocks 14 by the K or tensile force $F_k$ of spring 28 which is slightly stretched to create tension. Spring 28 can be calibrated so that the weight of the front or rear end of a vehicle moving in the authorized direction T can rotate rod 16 and the row of spikes 18, counterclockwise as shown in FIG. 2, causing spikes 18 to be lowered into the second position. Naturally, tensile force $F_k$ causes the row of spikes 18 to spring back into the first position immediately reactivating barrier A for blocking or inhibiting vehicle traffic travelling in the opposite or wrong direction.

However, since spikes 18 are held in the lowered position between tread support blocks 14 while the vehicle tires rest on tread support blocks 14, the authorized vehicle can cross vehicle barrier A safely without being damaged by spikes 18. Generally, the spring is calibrated so that the weight of the lightest standard vehicle can depress the spikes without causing damage to its tires. The torque generated by spring 28 is such that the weight of at least two persons (e.g., approximately 240 lbs) must be applied to lower spikes 18 between tread support blocks 14. Accordingly, at least 3 persons would be needed to drive a car safely across vehicle barrier A in the unauthorized direction.

In a preferred embodiment, each spike 18 has a cylindrical section **18*a* firmly secured to rod 16 and a conical section 18*b* with a damaging tip 18*a* extending from the top of cylindrical section 18*a*. The length of each spike 18 preferably is such that spike tip 18*c* does not extend past the far end 14*a* of tread support block 14 when spikes 18 are in the second position. As a result of the structure, the back ends of tires crossing vehicle barrier A in the authorized direction T will not be gouged by spike tips 18*c*. Since spikes 18 immediately return to this damaging position, vehicles should not back-up after crossing vehicle barrier A as their tires could be punctured by tips 18*c***.

In addition, the operating mechanisms may include a pneumatic or hydraulic pump 34 having a piston 36 and an associated piston rod 38 which is coupled to end **16*b* of rod 16 for providing a force to assist in the setting of adjustment device 32 and the desired angular position of the row of spikes 18. Pump 34 can be driven by a motor 39 such as electric hydraulic or other drive mechanisms via a worm or other conventional means and its piston rod 38 can be coupled to rod end 16*b* via a forked member 40 which is secured to rod 16. Forked member 40 is U-shaped and extends toward and receives piston rod 38 between its U-shaped fork. A slot 42 is formed in piston rod 38 and a pin 44 extends between the U-shaped fork of forked member 40 and is received through slot 42 thereby coupling pump 34 to rod 16**.

Slot 42 can be made to have a length sufficient to allow downward rotation of the row of spikes 18 (clockwise movement in FIG. 4) but prevents the row of spikes from rotating upwardly past the set angular position determined by adjustment device 32. Thus, piston rod slot 42 serves as a stop which effectively prevents spring 28 from pulling the row of spikes 18 up further and keeps the row of spikes in the selected angular position. When a vehicle moving in the wrong direction impacts spikes 18, the stop of piston rod slot 42 holds the spikes in their damaging position. As a result, the tension setting and the force required to obtain the same remains in its operative position regardless of the number of times the vehicle barrier is impacted by a vehicle.

In a preferred embodiment, adjustment device 32 (see FIGS. 5 and 6) includes an arm member 46 which is securely attached to rod end 16*b* by conventional means such as welding. Arm member 46 has two arms 48, 50 which form a slot for slidably receiving a circular cam 54. A plate 55 is secured to the top of arms 48, 50 closing the top of arm member slot 52. Spring end 28*b* passes through an axial bore 56 of circular cam 54 and a screw-threaded rod 58 is movably disposed within the arm member slot 52 above circular cam 54. Screw-threaded rod 58 passes through a hole in plate 55 and has a head 60 at one end and a free end 62 at the other which engages a recess 64 formed between sidewalls of circular cam 54.

In order to move circular cam 54 along slot 52, a pair of nuts 68 may be used which are disposed on either side of plate 55. An operator using a conventional wrench or the like can turn head 60 of screw-threaded rod 58 until cam 54 is in the desired location. Nuts 68 are securely tightened to hold screw-threaded rod 58 in the desired position. The bottom nut 68 can be securely welded to the bottom of plate 66 so that it is maintained in its appropriate position during operation.

Figure 5:
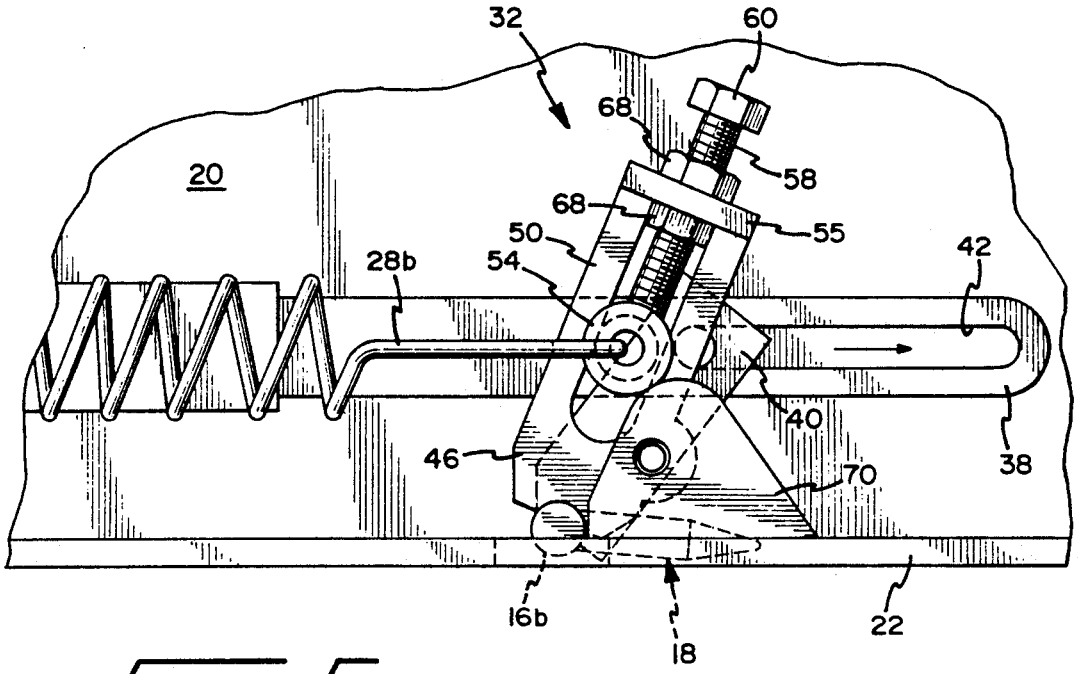
FIG. 5 is an enlarged perspective view of the operating mechanism end coupled to the rod of spikes, showing the row of spikes and associated mechanisms in their lowered position.
Figure 6:
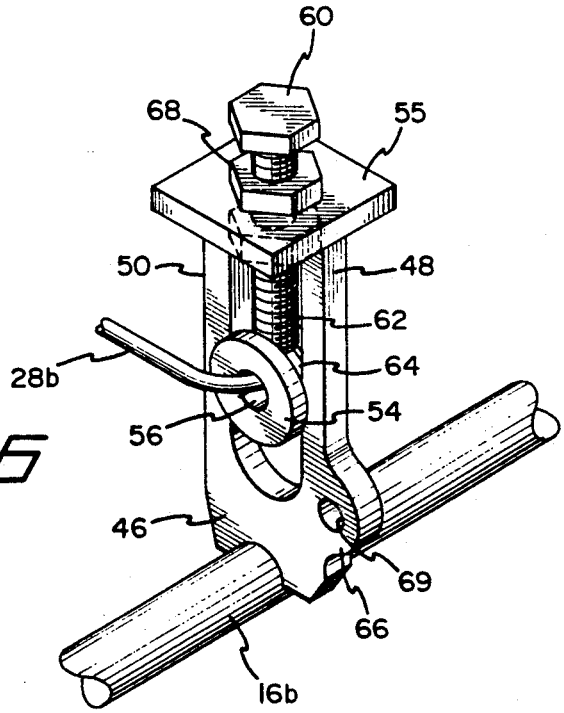
FIG. 6 is an enlarged, perspective view of adjustment means according to the invention.
Figure 10:
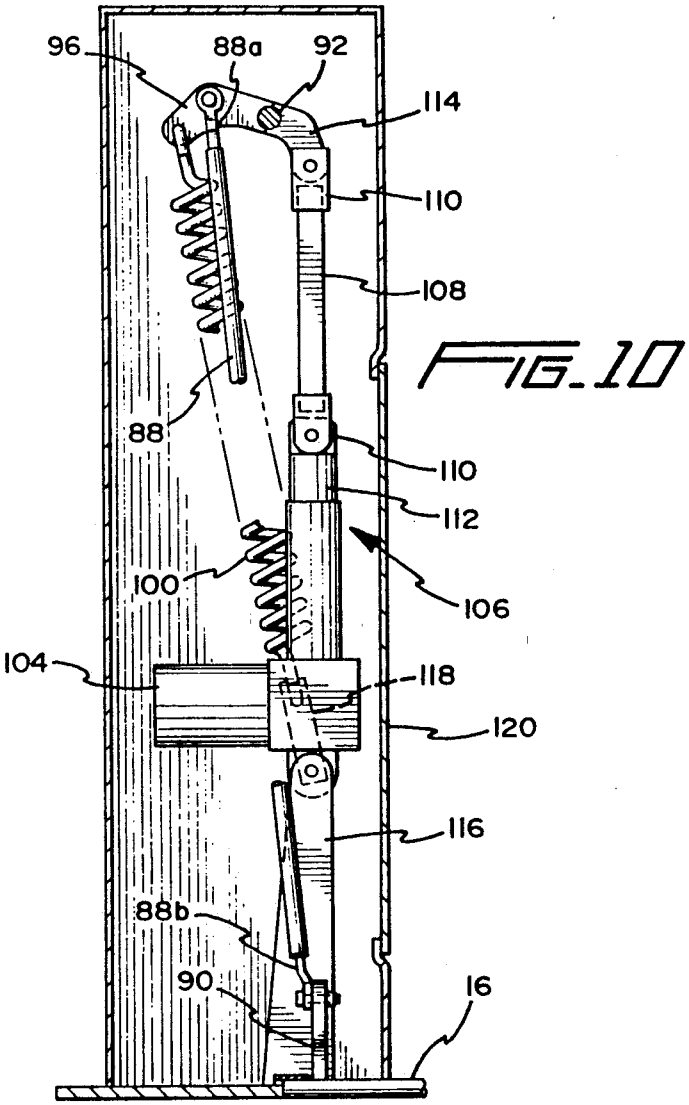
FIG. 9 and 10 are side and front views, respectively, of a housing shown in cross-section showing the operating means of a combined barrier according to the invention in their operative position for holding the row of spikes in the raised position.
Figure 9:
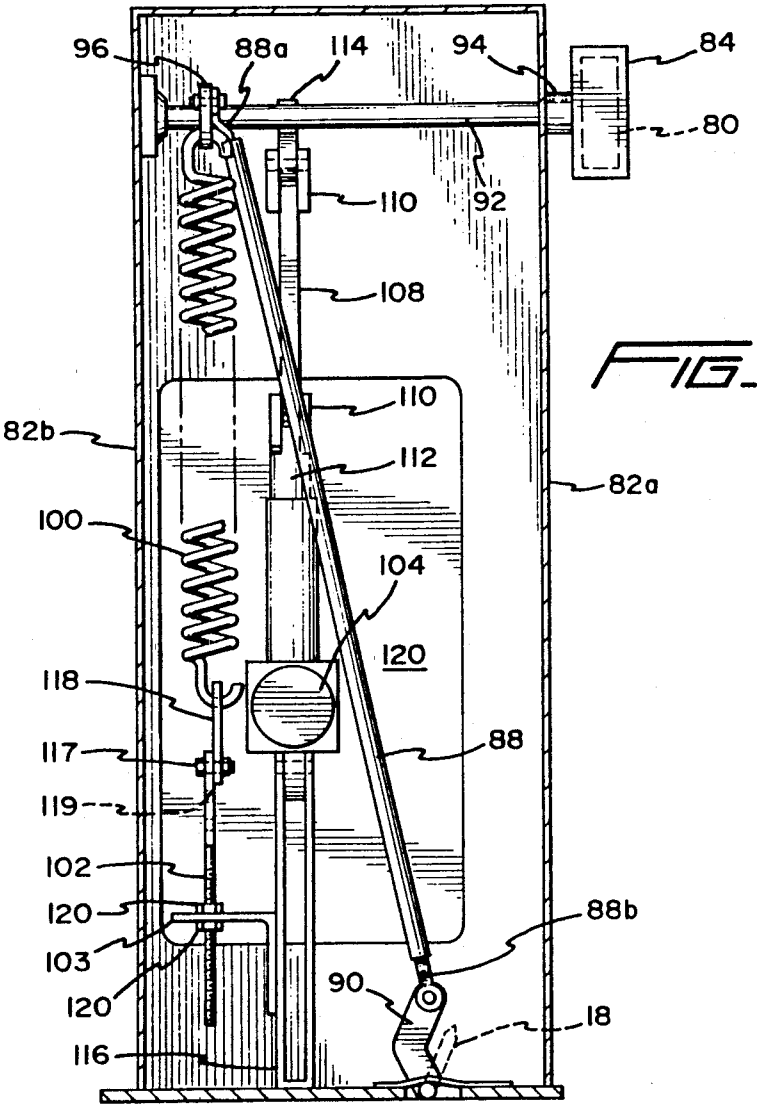
Figure 12:
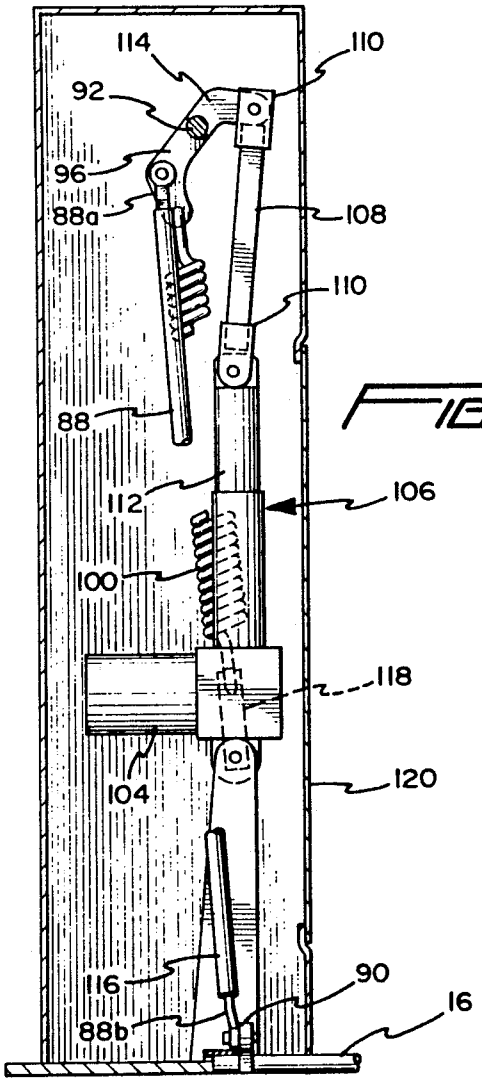
FIGS. 11 and 12 are side and front views like FIGS. 9 and 10, respectively, but showing the operating means and row of spikes in the lowered position to permit traffic flow.
Figure 11:
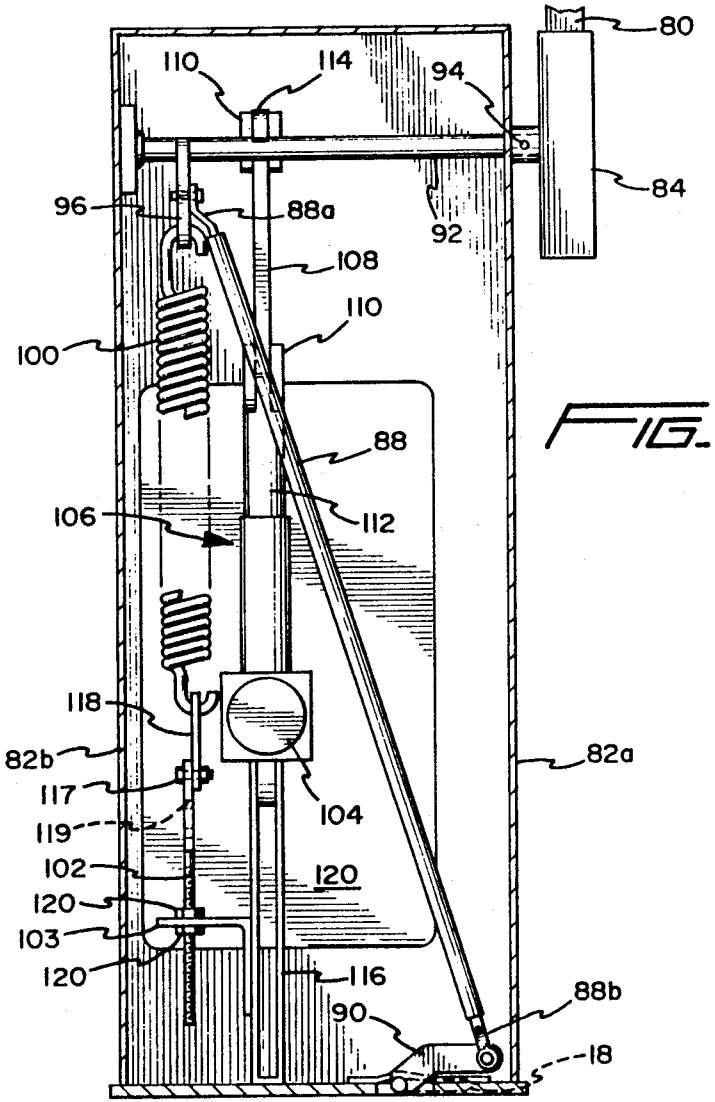

As shown in FIG. 5, pump 34 can be activated manually or by electrical controls (not shown) causing piston rod 38 to rotate rod 16 and thus spikes 18 into the retracted or lowered position. Thus with electrically controlled pump 34, an attendant can automatically lower spikes 18 to allow traffic to flow in the unauthorized direction. Motor 39 can be operated in reverse retracting piston rod 38 (toward the left in FIG. 5). Accordingly, the tensile force of extended spring 28 would cause rod 16 to rotate (counterclockwise in FIG. 5) raising spikes 18.

A projection can be formed 66 on a side of arm 48 of adjustment device 32 with a throughhole 69 which can be used to permanently lock vehicle barrier A in the deactivated position. An operator using a mechanical lever or pump 34 can rotate rod 16 and thus adjustment device 32 to line projection hole 69 with a hole formed through a immovable lug 70 projecting from floor plate 22. A pin or other device (not shown) can then couple projection 66 to lug 70.

COMBINED VEHICLE BARRIER

In an alternative embodiment of the invention, a vehicle barrier A' may be used in combination with a signal barrier or a swinging gate 80 which is pivotally mounted to a housing 82 enclosing the operating mechanisms of this embodiment. The structure of vehicle barrier A' is similar to that described above with reference to FIG. 1, except for the operating mechanisms and housing structure. Accordingly, the same reference numerals are used to designate like components.

Similar to floor plate 22 of housing 20, housing 82 is securely mounted on a ground surface adjacent support plate 10 of the grade-level barrier A'. Housing 82 is arranged so that a front surface 82*a* is substantially flush with a side of support plate 10. A support 84 is rotatably attached to the outside of front surface 82*a* of housing 82. Swinging gate or gate arm 80 is held within support 84 by conventional means such as pins and is disposed at a height suitable for stopping oncoming traffic.

Grade-level barrier A' is disposed so that the row of spikes 18 on support plate 10 point in the direction of oncoming traffic. When spikes 18 are in their raised position, swinging gate 80 will be in its lowered position to stop vehicles before reaching the damaging spikes 18. Likewise, when swinging gate or gate arm 80 is in its raised position (indicated by 80' in FIG. 1), spikes 18 are lowered between and beneath the surface of tread blocks 14. Accordingly, this embodiment is designed for use as a checkpoint before allowing vehicles to enter or leave a facility. According to this embodiment of the invention, an operator or attendant can remotely control swinging gate 80 and the row of spikes 18 between an open position allowing traffic to flow and a closed position blocking traffic. The electrical circuitry for providing such control is not a part of this invention and those having ordinary skill in the art would know how to implement the same. In addition, red and green signal lights 86 may be mounted above housing 82 via conventional means which an operator can change to indicate whether the road is open (green light) or closed (red light) using conventional electronic or electrical controls.

As can be seen FIG. 8, support plate 10 and housing 82 can be embedded within a roadway for smoother traffic flow. The end of an adjustable control lever 88 and an associated rocker arm 90 which is securely connected to rod 16 are shown through the portion of housing 82 that is removed in FIG. 8 and together serve to raise and lower spikes 18 as described below.

With reference to FIGS. 9–12, the operating mechanisms which are accessible, for example, through a door 82*d* of housing 82 will be described. The operation of the movement of swinging gate 80 and the row of spikes 18 in unison between a "go" or "stop" position can be controlled by these mechanisms. An interconnecting shaft 92 is mounted for rotation to a rear end 82*b* of housing 82 and extends horizontally through front end 82*a* of housing 82. Attached to the back wall of rotatable support 84 is a cylindrical projection 94 which has an inner diameter slightly greater than the diameter of interconnecting shaft 92. Cylindrical projection 94 is then secured via conventional means to the end of shaft 92 which extends through housing 8 thereby mounting rotatable support 84 and thus swinging gate 80 for movement between a closed position (see FIGS. 7 and 9) and an open position (see FIG. 11).

The upper end 88*a* of adjustable control lever 88 is coupled to the middle of a bracket 96 which is secured at one end to shaft 92. The other or free end of bracket 96 has a through hole for receiving an end of spring 100. The other end of spring 100 may be connected to an adjusting assembly which includes a vertically disposed support rod 102, and a plate 103 disposed underneath interconnecting shaft 92. Spring 100 maintains a constant tension against bracket 96 applying a counterclockwise rotation on shaft 92 maintaining the gate 80 in the closed position and spikes 18 in the up position as shown in FIG. 7. In addition, further downward rotation of bracket 96 causes adjustable control lever 88 to push rocker arm 90 down thereby rotating rod 16 and its row of spikes 18 into the space between tread blocks 14, at the same time elevating gate 80, thus permitting a vehicle to pass.

A motor 104 and a cylinder and piston arrangement 106 is employed to actuate the rotation of shaft 92. As shown in the FIGS. 11 and 12, a lever 108 is coupled via a U-shaped bracket and pin assembly 110 to the movable piston 112 of cylinder assembly 106. The other end of lever 108 is coupled via another U-shaped bracket and pin assembly 110 to a bracket 114 which is secured to shaft 92. Motor 104 is pivotally mounted on a support 116 which is attached to the floor of housing 82. In the FIGS. 9–12, the mechanism in the lowered gate 80 and raised spike 18 positions will not yield to a weight such as a vehicle because of the positive lock action of the motor 104 and piston cylinder arrangement 106.

Brackets 96 and 114 may be welded to interconnecting shaft 92 at different positions along the shaft but, are attached on opposite sides of this shaft so that when piston 112 is retracted pulling bracket 114 downwardly (clockwise direction in FIG. 10), bracket 96 is rotating upwardly extending spring 100 and pulling rocker arm 90 up thereby lifting spikes 18 into their raised position. Simultaneously, swinging gate 80 is lowered. Likewise, when piston 112 is driven upwards by motor 104, spring 100 continues to apply tension pushing bracket 96 upwards and rotating shaft 92 counterclockwise. Thus, spring 100 and motor 104 work together to rotate shaft 92 raising swinging gate 80 and lowering spikes 18 to allow traffic to flow. As a result of this structure, only a small motor, preferably 1/6 horsepower is required to power both the raising of swinging gate 80 and the lowering of spikes 118. Further, since spring 100 serves as a counter spring swinging gate 80 can extend across the entire width of the roadway to be blocked by this combined vehicles barrier.

This embodiment has means for adjusting the angular position of the row of spikes 18 when in the "stop" or raised position. In a preferred embodiment, adjustable control lever 88 may serve as the adjusting means as described below. The two ends 88*a*, 88*b* of the tubular control lever 88 can be separate structures which are movably inserted within the tubular control lever 88. For example, ends 88*a*, 88*b* may be screw-threaded bolts with an eyelet where the eyelet end is coupled to rocker arm 90 or bracket 96 and the screw-threaded bolts are received within matching screwthreads of control lever 88. Preferably, the inner ends of tubular control lever 88 are reversed threaded so that the tubular lever can be rotated as a turnbuckle to adjust the length of control lever 88 which in turn would adjust the angular position of the row of spikes. In addition, the tension of spring 100 may be adjusted or varied by moving the bolt and nut assembly 117 of plate 118 in holes 119. Tension on spring 100 can be further adjusted by screwing support rod 102 into plate 103. Lock nuts 120 secure the rod 102 against movement.

The embodiment of FIGS. 7–12 is preferably remotely controlled by an operator stationed in an attendant's booth adjacent the roadway checkpoint formed by the combined vehicle barrier. Any conventional means which would supply power to motor 106 remotely can be used to employ this embodiment. In addition, the swinging gate and the spikes can be manually deactivated if the piston assembly 106 is disassembled from motor 104. Thus, this combined vehicle barrier can be manually overridden if the electronics fail or need repair.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

We claim:

1. A vehicle barrier for positioning on a roadway or the like comprising:

a) a support plane adapted for placement across a roadway;

b) a plurality of tread support means formed in series on said support plate with a space between adjacent tread support means;

c) a rod having a row of spikes attached thereto and being rotatably disposed across said support plate so that said spikes are movably received between respective spaced tread support means;

d) tensioning means, coupled to an end of said rod, for maintaining said row of spikes in a first position extending above said spaced tread support means and forming an acute angle with said support plate;

e) said tensioning means including:

i) a spring fixed at one end to an immovable member, the other end of which engages said adjustment means; and ii) pump means adapted for connection to said end of said rod, for providing a force to assist in raising and lowering said spikes;

f) means for lowering said row of spikes into a second position between said spaced tread support means; and g) whereby said row of spikes in said first position rotate downwardly into said second position when impacted by a vehicle approaching said barrier from one direction but are maintained in said first position by said tensioning means when impacted by a vehicle approaching from the other direction.

2. A vehicle barrier according to claim 1 wherein:

a) said row of spikes are in spaced alignment so that each tire of a vehicle impacts at least one of said spikes.

3. A vehicle barrier according to claim 1, further comprising:

a) means, in communication with said tensioning means, for adjusting and setting a preselected tension.

4. A vehicle barrier according to claim 1, wherein said tensioning means further includes:

a) stop means for allowing downward rotation of said row of spikes and for preventing said row of spikes from rotating past said set angular position when in said first position.

5. A vehicle barrier according to claim 4, wherein:

a) said pump means includes a cylinder and a piston, and b) said stop means is a slot formed in the rod of said piston.

6. A vehicle barrier according to claim 1 wherein said adjustment means includes:

a) an arm member secured to said rod at one end and having a slot for receiving a pin;
b) a circular cam having an axial bore and a rim slidably mounted within said slot, said other end of said spring passing through said axial bore; and
c) bolt means, including a pin movably disposed within said slot above said cam, for sliding said circular cam and adjusting the tension on said tensioning means.

7. A vehicle barrier according to claim 6, wherein:
a) said rim of said circular cam has two sidewalls which form a central recess about said rim;
b) said arm member has two arms which form said slot, said arms engaging said recess for guiding said cam as it slides within said slot; and
c) said pin of said bolt means is a screw-threaded rod having a head at one end and a free end at the other for engaging said cam recess, and nut means for securing said screw-threaded rod against movement, subsequent to adjustment of said tensioning means.

8. A vehicle barrier for positioning on a roadway or the like comprising:
a) a support plate adapted for placement across a roadway;
b) a plurality of tread support means formed in series on said support plate with a space between adjacent tread support means;
c) said tread support means including:
i) a row of spaced tread blocks mounted in series on said support plate; and
ii) each tread block having a height slightly greater than the diameter of each spike;
d) a rod having a row of spikes attached thereto and being rotatably disposed across said support plate so that said spikes are movably received between respective spaced tread support means;
e) tensioning means, coupled to an end of said rod, for maintaining said row of spikes in a first position extending above said spaced tread support means and forming an acute angle with said support plate;
f) means for lowering said row of spikes into a second position between said spaced tread support means; and
g) whereby said row of spikes in said first position rotate downwardly into said second position when impacted by a vehicle approaching said barrier from one direction but are maintained in said first position by said tensioning means when impacted by a vehicle approaching from the other direction.

9. A vehicle barrier according to claim 8, wherein said tread support means further includes:
a) a tread support plate having a height substantially equal to the height of each tread block; and
b) said rod of spikes is rotatably mounted between said tread support plate and said row of tread blocks.

10. A combined barrier for controlling vehicle traffic comprising:
a) a vehicle barrier for positioning on a roadway including:
i) a support plate adapted for placement across a roadway;
ii) a plurality of tread support means formed in series on said support plate with a space between adjacent tread support means;
iii) a rod having a row of spikes attached thereto and being rotatably disposed across said support plate so that said spikes are movably received between respective spaced tread support means;
iv) tensioning means, coupled to an end of said rod, for maintaining said row of spikes in a first position extending above said tread support means plates and forming an acute angle with said support plate;
v) said tensioning means including a counter spring fixed at one end to an immovable member, the other end of which is coupled to said interconnecting means;
vi) means for lowering said row of spikes into a second position between said spaced tread support means; and
b) a housing disposed adjacent an end of said support plate;
c) swinging gate means mounted to said housing above said vehicle barrier for movement between open and closed positions;
d) means, disposed within said housing and coupled to said swinging gate means and said tensioning means, for interconnecting the movement of said swinging gate means with the movement of said row of spikes;
e) operating means, in communication with said interconnecting means, for moving said swinging gate means and said row of spikes in unison between an open or second position and a closed or first position; and
f) said operating means including:
i) a motor; and
ii) cylinder means, driven by said motor, for imparting motion to said interconnecting means thereby causing said swinging gate means and row of spikes to move.

11. A combined barrier according to claim 10, further comprising:
a) means for adjusting the angular position of said row of spikes in said first position;
b) said adjusting means being in communication with said tensioning means and coupled to said end of said rod.

12. A combined barrier according to claim 10, wherein said interconnecting means comprises:
a) a shaft mounted for rotation within said housing and coupled at one end to said swinging gate means;
b) a first bracket, having a first end secured to said shaft and a second end coupled to said cylinder means; and
c) a second bracket secured to said shaft and to said counter spring.

13. A combined barrier according to claim 11, wherein said adjusting means comprises:
a) a plurality of arm members linked together to form an adjustment unit.

14. A combined barrier according to claim 13, wherein said arm members comprise:
a) a shaft mounted for rotation within said housing area coupled at one end to said swinging gate means;
b) a rocker arm, one end of which is secured to said rod of spikes; and
c) a tubular arm having one end secured to said one end of said rocker arm and the other end secured to said shaft.

15. A combined barrier according to claim 14, wherein a) the length of said tubular arm is adjustable; and
b) said first and second ends are movably attached to said tubular arm for adjusting the length of said tubular arm and the angular position of said row of spikes.

16. A combined barrier according to claim 10, wherein:
a) said housing includes signal means.

17. A combined barrier according to claim 10, and wherein:
a) said signal means includes sequentially operating lights determined by raising and lowering said gate means and/or said spikes.

18. A vehicle barrier assembly comprising:
a) a barrier support housing having upper and lower sections;
b) a shaft rotatably journalled in said housing upper section and having one end extending outwardly from said housing and the other end positioned inside said housing;
c) a gate arm rotatably mounted on said one end of said shaft and movable between horizontal and vertical positions;
d) said other end of said shaft having a lever secured thereto and rotatably with said shaft;
e) said lever arm having a first end;
f) drive means in said housing connected to said shaft for moving said gate arm between said vertical and said horizontal positions;
g) gate arm counter balance spring means in said housing having first and second ends;
h) said gate arm counter balance spring means extending downwardly from said upper section into said lower section and having its first end secured to said first end of said lever arm;
i) said lower section of said housing including spring tension adjustment means;
j) said spring tension adjustment means connected to said second end of said gate arm counter balance spring means for adjustably tensioning said counter balance spring means; and
k) said drive means and said gate arm counter balance spring means working in cooperation with each other whereby a minimum amount of energy will be required by said drive means to raise said gate arm to a vertical position.

19. A vehicle barrier as in claim 18 and wherein:
a) said tension spring means includes an adjustable threaded bolt assembly.

20. A vehicle barrier as in claim 18 and wherein:
a) said lever arm includes a second end; and
b) said second end in connected to said drive means.

* * * * *